United States Patent [19]

Guelden

[11] 4,352,537

[45] Oct. 5, 1982

[54] CORD ADAPTER

[75] Inventor: Ronald H. Guelden, Shreveport, La.

[73] Assignee: Bell Telephone Laboratories, Incorporated, Murray Hill, N.J.

[21] Appl. No.: 158,401

[22] Filed: Jun. 11, 1980

[51] Int. Cl.[3] ..... H01R 4/24

[52] U.S. Cl. ..... 339/99 R; 339/97 P; 339/103 C; 339/103 M

[58] Field of Search ..... 339/97 R, 97 P, 98, 339/99 R, 103 C, 103 M

[56] References Cited

U.S. PATENT DOCUMENTS

| | | | |
|---|---|---|---|
| T958,009 | 5/1977 | Snyder | 339/99 R |
| 1,950,036 | 3/1934 | Preston | 339/103 C |
| 3,499,103 | 3/1970 | Pearce | 339/106 |
| 3,573,713 | 4/1981 | Enright et al. | 339/98 |
| 3,982,809 | 9/1976 | Ward et al. | 339/91 R |
| 3,985,416 | 10/1976 | Dola et al. | 339/98 |
| 4,002,392 | 1/1977 | Hardesty | 339/99 R |
| 4,188,505 | 2/1980 | O'Connor | 179/1 PC |
| 4,284,316 | 8/1981 | Debaigt | 339/98 |

*Primary Examiner*—John McQuade

*Attorney, Agent, or Firm*—S. J. Chin; H. L. Newman

[57] ABSTRACT

A cord adapter (100), which includes a modular connector assembly (110) and a cover (270), is disclosed for use by a telephone customer to terminate a telephone mounting cord (10) comprising a plurality of insulated conductors (16) without spade terminals (12) at their ends. The modular connector assembly includes insulation-piercing contacts (184) and a conductor receptacle (240) with orifices (252) for receiving the insulated conductors, while the cover includes surfaces (289) which press the receptacle against the contacts to establish reliable electrical connection between the conductors and the contacts when the cover is fastened to the assembly.

5 Claims, 8 Drawing Figures

CORD ADAPTER

TECHNICAL FIELD

This invention relates to a cord adapter and more particularly to a cord adapter which converts a conventional telephone mounting cord into a cord with a modular connector.

BACKGROUND OF THE INVENTION

U.S. Pat. No. 4,188,505, issued to O'Connor and assigned to the assignee of this application, discloses a modular jack converter which a telephone customer can use to convert a conventional telephone terminal block. The modular jack converter disclosed in O'Connor was designed partly to minimize physical tampering of conductive screw terminals in the terminal block. If a telephone mounting cord is connected to the terminal block, the customer is instructed to sever the spade terminals from the ends of the insulated conductors in the telephone mounting cord before he connects the modular jack converter to the screw terminals in the terminal block. However, the customer may also want to convert the conventional telephone mounting cord into a modular cord.

Hence, one object of this invention is to develop a cord adapter which can convert a conventional telephone mounting cord onto a modular cord where the spade terminals on the insulated conductors have already been removed or are nonexistent.

A second object is that the cord adapter be easy to assemble.

A third object is that the cord adapter be inexpensive and easy to manufacture.

SUMMARY OF THE INVENTION

In accordance with this invention, a cord adapter has been developed which includes a modular connector assembly and a cover. The modular connector assembly includes a conductor receptacle for receiving the insulated conductors of a mounting cord, and a plurality of conductive insulation-piercing contacts for engaging the insulated conductors; while the cover includes surfaces for urging the receptacle containing the insulated conductors against the insulation-piercing contacts to establish reliable electrical connection when the cover is fastened to the connector assembly.

The invention and its objects, features and advantages will be readily discerned from a reading to follow of an illustrative embodiment.

DETAILED DESCRIPTION

Figure 1:
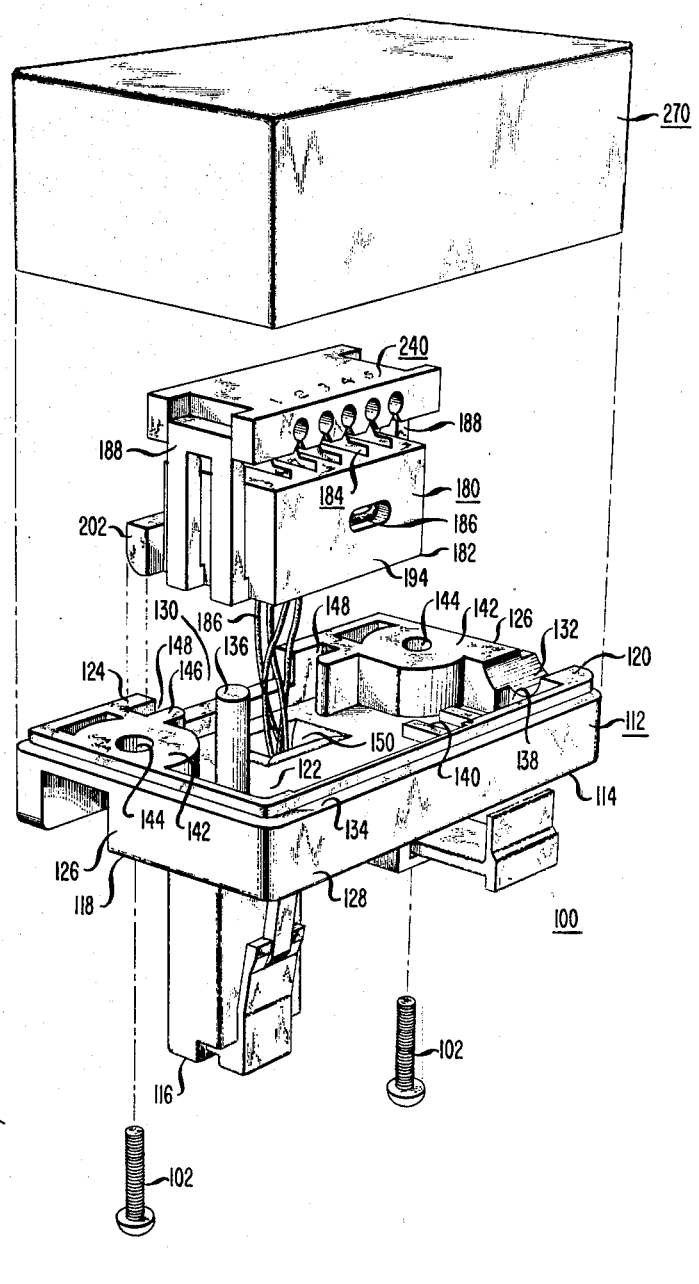
FIG. 1 is a front perspective view of an unassembled cord adapter made in accordance with this invention, where the modular connector assembly is shown partially exploded.
Figure 2:
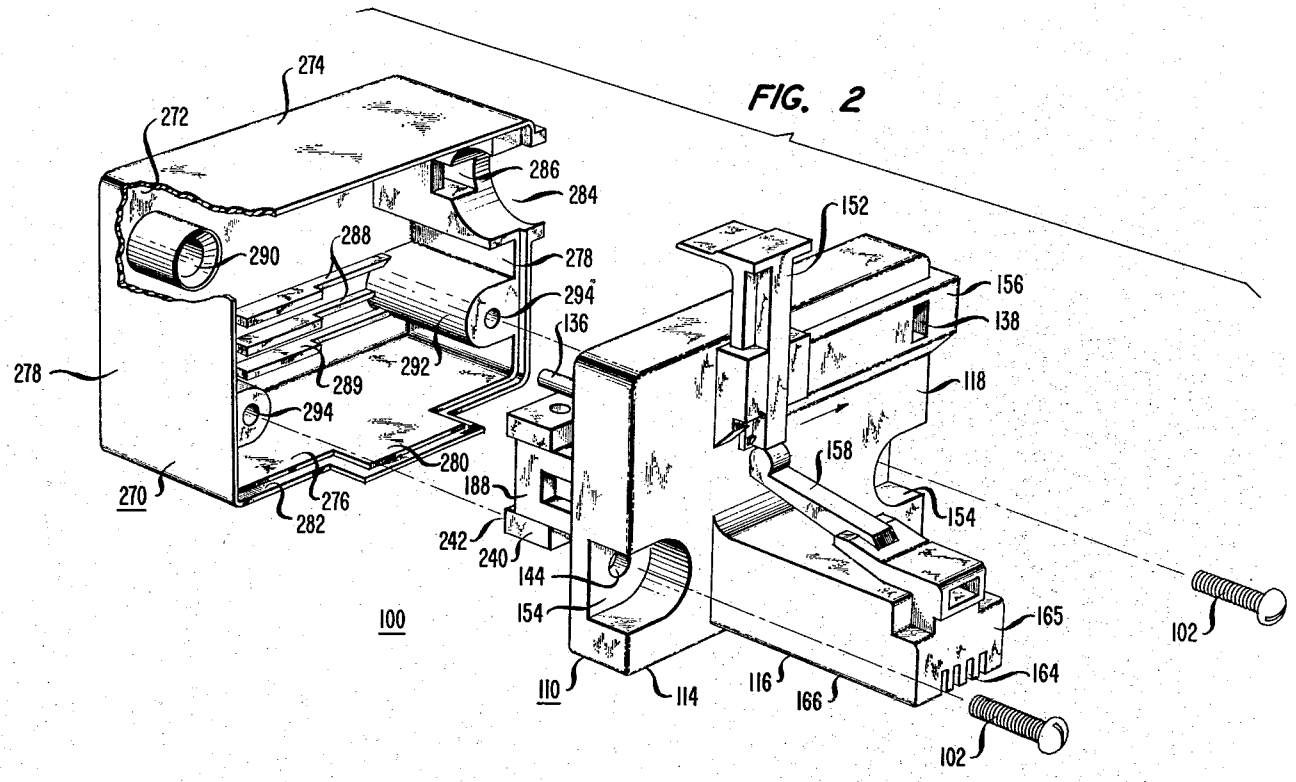
FIG. 2 shows a bottom perspective view of the unassembled cord adapter with the cover shown in partial cutaway.

Referring to FIGS. 1 and 2, the illustrative embodiment 100 of the cord adapter comprises a modular connector assembly 110, a cover 270, and threaded screws 102 for fastening the cover 270 and the connector assembly 110 together. The cord adapter 100 is designed to electrically terminate a plurality of insulated conductors 16 from a telephone mounting cord 10, where the spade terminals 12 normally attached to the ends 14 of the insulated conductors 16 have been severed from the remaining lengths of the insulated conductors 16 as seen in FIG. 8.

Figure 8:
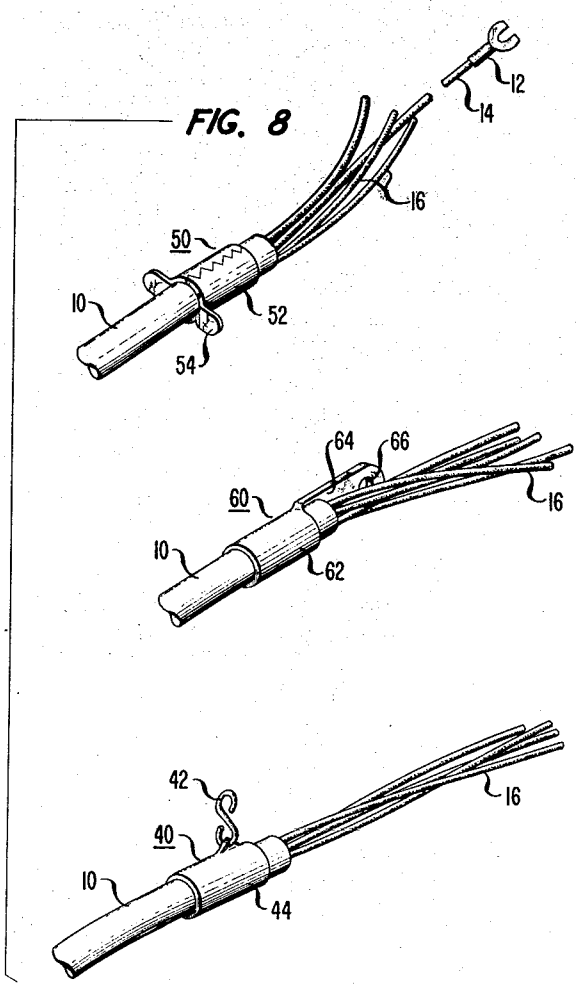
FIG. 8 depicts three telephone mounting cords with different strain relief bands.

FIG. 8 also depicts three commonly used strain relief bands which are shown attached to different mounting cords 10 and for which the illustrative cord adapter 100 is designed to accommodate. One strain relief band 40 has an S-shaped hook 42 attached to a cylindrical band 44 which securely engages the cord 10. A second strain relief band 50 includes a cord-holding band 52 with two outwardly extending radial wings 54 disposed at one longitudinal end of the band 52. A third strain relief band 60 includes a cord-holding band 62 having a longitudinal tab 64 with an aperture 66.

Referring back to FIG. 1, the modular connector assembly 110 includes a base 112; a contact assembly 180 comprising a contact holding body 182, a plurality of conductive insulation-piercing contacts 184, and a pair of substantially upright cantilevered members 188; and a conductor receptacle 240 in slidable engagement with the upright cantilevered members 188 of the contact assembly 180.

The base 112 is molded from a dielectric plastic material to form a platform 114 and a modular connector housing 116 extending from the underside 118 of the platform 114. The platform 114 comprises a substrate 122 from which a rear wall 124, two sidewalls 126, and a front wall 128 extend in upright fashion on the topside 120 of the platform 114. The rear wall 124 includes a rectangular cutout 130 for aligning the cover 270, while the sidewall 126 on the right in FIG. 1 includes a semicylindrical cutout 132 for forming a part of an access opening for the mounting cord 10. Running along the free edges of the walls 124, 126, 128 is a substantially continuous exterior groove 134 for engaging a complementary groove 282 (FIG. 2) in the cover 270.

Toward the front wall 128 of the platform 114 is an upright post 136 to which either a loop of the S-shaped hook 42 on the strain relief band 40 or the aperture 66 on the strain relief band 60 can be placed. On the substrate 122, near the semicylindrical cutout 132 is a recess 138 for seating one of the wings 54 on the strain relief band 50. Also, the substrate 122 includes near the recess 138 a pair of ribs 140. The ribs 140 help to maintain the cord 10 with the strain relief band 50 in a lateral position on the platform 114 so that the other wing 52 can align with a corresponding recess 286 (FIG. 2) in the cover 270 as the adapter 100 is assembled.

Molded with either sidewall 126 is an embossment 142 having an aperture 144 for accommodating one of the screws 102. An upright partition 146, which extends from either embossment 142, defines with the rear wall 124 a mounting groove 148 for positioning the contact assembly 180 on the platform 114. Also, disposed between the embossments 142 is the entrance to a conductor receiving cavity 150 of the connector housing 116. The cavity 150 is designed to receive a plurality of insulated conductors 186 from the contact assembly 180.

Referring to FIG. 2, the underside 118 of the platform 114 comprises recesses 154 corresponding to the embossments 142 (FIG. 1) on the topside 120. Also, the platform 114 has a thickened surface area 156 for strengthening the platform 114 where the mounting cord 10 enters the modular connector assembly 110.

As also seen in FIG. 2 in the illustrative embodiment, the connector housing 116 is configured similar to the housing of a conventional modular plug used in the telephone industry. The connector housing 116 has been molded to accommodate a plurality of conductive terminals 162 (one shown in FIG. 3) which are held in parallel spaced slots 164 open to the bottom and rear sides 165, 166 respectively of the connector housing 116. The connector housing 116 also includes a resilient locking tap 158 designed to interact with corresponding surfaces in a telephone jack to either lock the modular plug in place or to release it. To facilitate use of the tab 158 in the modular connector assembly is an actuating member 152 held in slidable engagement along the underside 118 of the platform 114.

Figure 3:
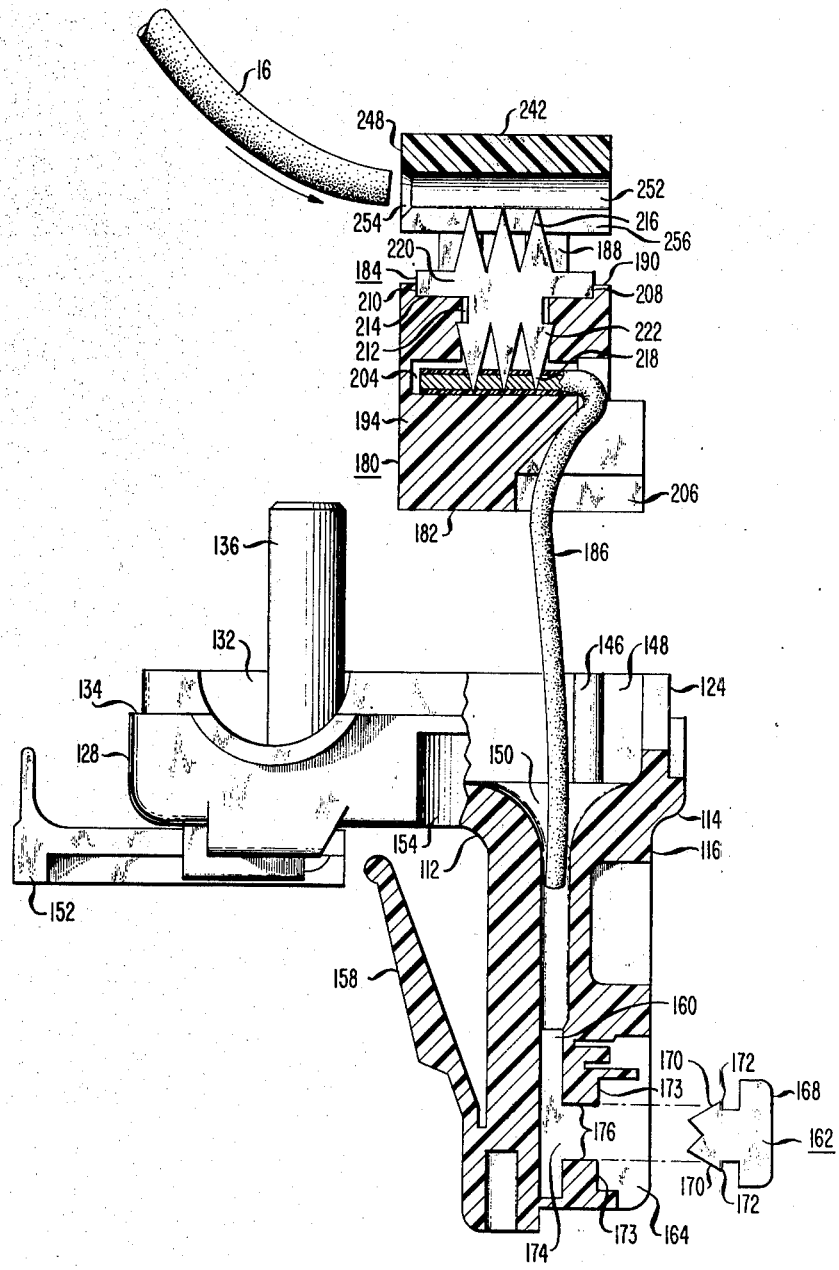
FIG. 3 is a partial cross-sectional and exploded view of the modular connector assembly.

Seen more clearly in FIG. 3 is the earlier mentioned conductor receiving cavity 150 of the connector housing 116. While the cavity 150 forms a common entrance for the insulated conductors 186, the cavity 150 leads to a plurality of parallel and separate conductor-receiving ducts 160, each of which is aligned with an associated slot 164. Hence, after a conductor 186 has been positioned in its associated duct 160, its associated terminal 162 is inserted into the associated slot 164 whereby the terminal 162 aligns with the conductor 186 to establish reliable electrical connection therewith.

Each terminal 162 of the modular plug is a planar conductive structure having a base portion 168 and a pair of tangs 170 extended therefrom. The outermost edges of the tangs 170 include barbs 172. As is visible in FIG. 3, each slot 164 has abutment surfaces 173 for limiting insertion of the base portion 168 and includes an inner region 174 of reduced width to allow penetration of its walls 176 by the barbs 172 to anchor each terminal 162 in its associated slot 164.

The modular plug disclosed in the illustrative embodiment is substantially identical to the modular plug disclosed in U.S. Pat. No. 4,002,392, issued to Hardesty et al. To the extent that the Hardesty et al patent is relevant, it is hereby incorporated by reference.

When in electrical engagement with the insulated conductors 186, the terminals 162 also advantageously retain the insulated conductors 186 against removal from the connector housing 116. The conductors 186 in turn anchor the contact assembly 180 in fixed relation with the platform 114 and the base 112. As can be readily seen in FIG. 3, the other end of the conductors 186 are retained in the contact holding body 182 of the contact assembly 180.

Figure 4:
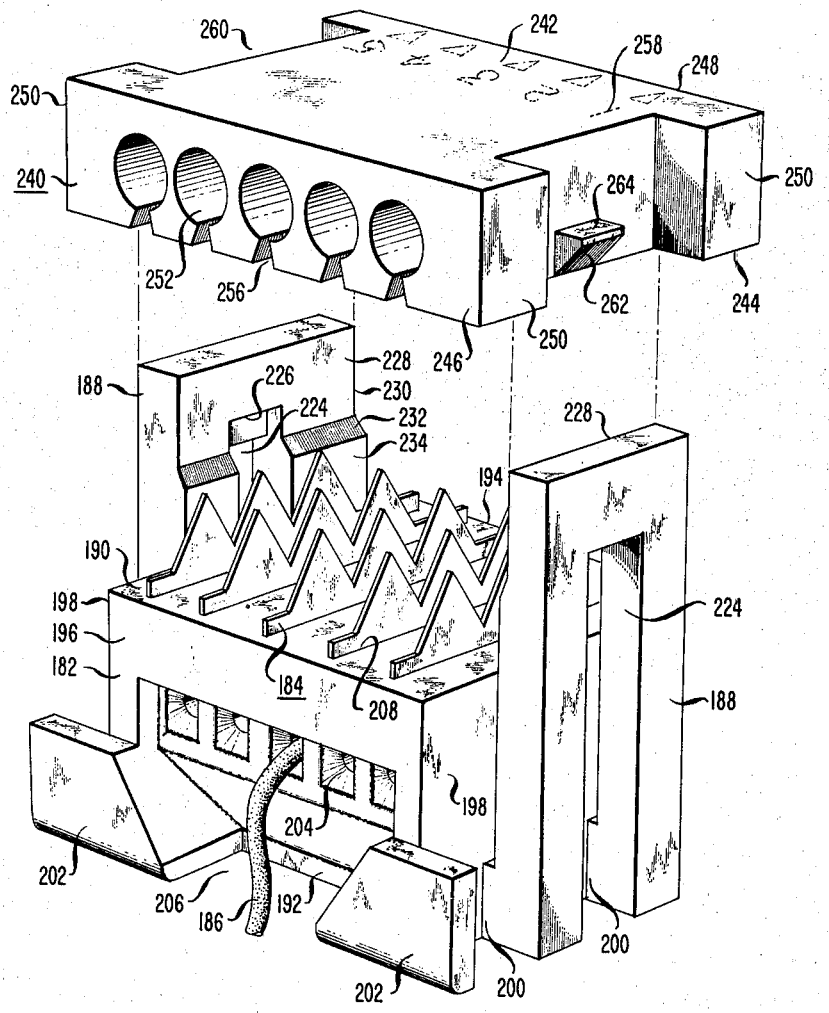
FIG. 4 illustrates a partial exploded rear perspective view of the conductor receptacle and the contact assembly.

Referring to FIG. 4, the contact holding body 182, which is molded from dielectric material, comprises a topside 190, an underside 192, a front side 194, a rear side 196, and lateral sides 198. On both of its lateral sides 198 near the underside 192 are tabs 200 integrally connecting the cantilevered members 188 mentioned earlier to the body 182. The contact holding body 182 has on its rear side 196 a pair of mounting tabs 202 for seating into the mounting grooves 148 (FIG. 1) on the platform 114, the entrances to a plurality of spaced-apart, parallel conductor-receiving bores 204, and a recess 206 for providing passage of the conductors 186 (only one shown in FIG. 4) from the bores 204 to the cavity 150 in the connector housing 116 of the base 112.

Three of the five bores 204 are closed to the front side 194 and configured like the bore 204 shown in FIG. 3, while two of the bores 204 are open to the front side 194 of the contact holding body 182. The latter two bores 204 allow a single conductor 186 to thread into the two bores 204 by turning around on the front side 194 as seen in FIG. 1.

Referring back to FIGS. 3 and 4, in the contact holding body 182 are also a plurality of spaced-apart, parallel slots 208 which are open to the topside 190 of the contact holding body 182 and in alignment and communication with respective bores 204. Each slot 208 is configured to carry one of the insulation-piercing contacts 184 to be described below.

Referring specifically to FIG. 3, each slot 208 has a top slot portion 210 of a first width and a bottom slot portion 212 of a second width. At the transition of each slot 208 from the top slot portion 210 to the bottom slot portion 212 are a pair of abutment surfaces 214.

FIG. 3 also shows one of the contacts 184 firmly retained in its associated slot 208. The contact 184 is formed from a substantially planar conductive material to have two sets 216, 218 of insulation-piercing tangs, each set extending from opposite sides of a base portion 220. The base portion 220 juts outward beyond the width of the tangs. The top set 216 of tangs is designed to electrically connect with an insulated conductor 16, while the bottom set 218 of tangs is designed to connect with an insulated conductor 186. The outermost tangs of the bottom set 218 have barbs 222 on their outer sides.

As can be readily seen in FIG. 3, each top slot portion 210 is of sufficient width to accommodate the base portion 220 of the associated contact 184. The abutment surfaces 214 are designed to limit insertion of the contact 184 by abutting bottom surfaces of the base portion 220. The bottom slot portion 212 is made of a width which is less than the distance between the outermost tips of the barbs 222 on the bottom set 218 of tangs. Thus, after the conductors 186 have been inserted into their respective bores 204, the contacts 184 can be inserted to establish electrical contact with the insulated conductors 186. The barbs 222 anchor the contacts 184 in place and securely retain the conductors 186 in the contact holding body 182.

During assembling of the connector assembly 110, the conductors 186 are first terminated in the contact assembly 180 before they are inserted into the connector housing 116 for connection with the terminals 162.

Referring to FIG. 4, each cantilevered member 188 is an elongated beam having a vertical guiding slot 224 which is closed at the top to define an abutment surface 226. The cantilevered members 188 have different transverse cross sections to fit into different sized notches 260 on the conductor receptacle 240. The facing walls 228 of the cantilevered members 188 are each defined by an upright first surface 230, an inclined second surface 232, and an upright third surface 234 which juts out beyond the first surface 230. These surfaces 230, 232, 234 function to help secure the conductor receptacle 240 in one of two stable positions as will be explained below after description of the conductor receptacle 240.

FIG. 4 shows the conductor receptacle 240 separated from the cantilevered members 188 of the contact assembly 180. The receptacle 240, essentially a block made from a dielectric material, comprises a top surface 242, a bottom surface 244, a rear wall 246, a front wall 248, and sidewalls 250. A plurality of parallel through orifices 252 extend from the front 248 to the rear wall 246. The front end of the orifices 252 have beveled entrance surfaces 254 (FIG. 3) to ease insertion of the insulated conductors 16. A longitudinal slit 256 along the length of each orifice 252 places each orifice 252 in communication with the bottom surface 244.

When the receptacle 240 is held by the cantilevered members 188, each orifice 252 and slit 256 is in vertical alignment with an associated insulation-piercing contact 184 in the contact assembly 180. The slits 256 are tapered to facilitate entry of the insulation-piercing contacts 184 from below. Also, the top surface 242 includes indicia 258 identifying each orifice 252 to indicate which insulated conductor 16 to insert. The conductors 16 are usually color-coded with colored insulation.

The sidewalls 250 include the vertical notches 260 of different sizes to interlock with their assigned cantilevered members 188. The different sized notches 260 are designed so that should the receptacle 240 be inadvertently removed from engagement with the cantilevered members 188, proper repositioning of the receptacle 240 with respect to the contact assembly 180 is ensured upon reattachment. Protruding from each sidewall 250 is a tab 262 with an upper horizontal surface 264 which is designed to engage the abutment surface 226 of the associated cantilevered member 188 to prevent removal of the receptacle 240.

Figure 7:
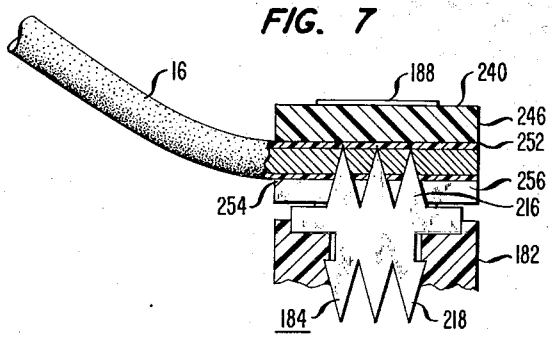
FIG. 7 is a cross sectional view of the conductor receptacle and part of the contact assembly showing an insulated conductor in intimate electrical connection with its associated insulation-piercing contact.

The first and second surfaces 230, 232 of the cantilevered members 188 are normally spaced apart the appropriate amount to hold the receptacle 240 in a first stable position, whereby the top set 216 of tangs from the contacts 184 do not protrude into the orifices 252 of the receptacle 240 as seen in FIG. 3. The cantilever members 188 are capable of flexing so that the third surfaces 234 of the cantilevered members 188 can be spaced apart the appropriate amount to hold the receptacle 240 in a second stable position, whereby the top set 216 of the tangs from the contacts 184 protrude into the orifices 254 and establish intimate electrical connection with inserted conductors 16 as seen in FIG. 7. The second surfaces 234 allow the receptacle 240 to slide from the first to the second stable position.

Referring back to FIG. 2, the cover 270, mentioned earlier, is a substantially rectangular housing made of dielectric material. It has a roof 272, a front wall 274, a rear wall 276, and two sidewalls 278. The rear wall 276 includes a rectangular tab 280 projecting from the otherwise bottom edge of the rear wall 276. Also, running along the free bottom edges of all the walls 274, 276, 278 of the cover 270 is the substantially continuous interior groove 282. The tab 280 is configured to interlock with the rectangular cutout 130 (FIG. 1) of the connector assembly 110, while the groove 282 is configured to interlock with the exterior groove 134 (FIG. 1). Together, they help to properly position the cover 270 with the connector assembly 110 during fastening.

The sidewall 278, corresponding to the right sidewall 126 (FIG. 1) of the connector assembly 110, includes a semicylindrical cutout 284 at its bottom edge to form with the cutout 132 (FIG. 1) of the connector assembly 110 the access opening for the mounting cord 10. Adjacent the cutout 284, the sidewall 278 is thickened and includes a recess 286. The recess 286 is designed to align with the recess 138 in the connector assembly 110 to accommodate one of the wings 54 of the strain relief band 50. The roof 272 also includes a cylindrical bore 290 for receiving the post 136 on the connector assembly 110.

A plurality of ribs 288 with surfaces 289 for engaging the top surface 242 (FIG. 3) of the receptacle 240 protrude from the interior of the roof 272 near the rear wall 276. Also, integrally molded with either sidewall 278 is a protuberance 292 with an unthreaded hole 294. The holes 294, which receive the screws 102, are in alignment with the apertures 144 in the connector assembly 110. The holes 294 become threaded as the screws 102 are driven in.

To terminate a mounting cord 10, the receptacle 240 is first moved into the first stable position to allow insertion of the insulated conductors 16. The strain relief band of the mounting cord 10 is then affixed to the appropriate means on the platform 114 depending on the strain relief band involved, after which the insulated conductors 16 are threaded into the orifices 252 from the front wall 248. After the conductors 16 are inserted into their orifices 252, the receptacle 240 is manually pressed down to mechanically hold the conductors 16 in the orifices 252 with the top tangs of the contacts 184 to prevent inadvertent removal of the conductors 16. Then the ends of the cord conductors 16 extending beyond the rear wall 246 are severed.

Figure 5:
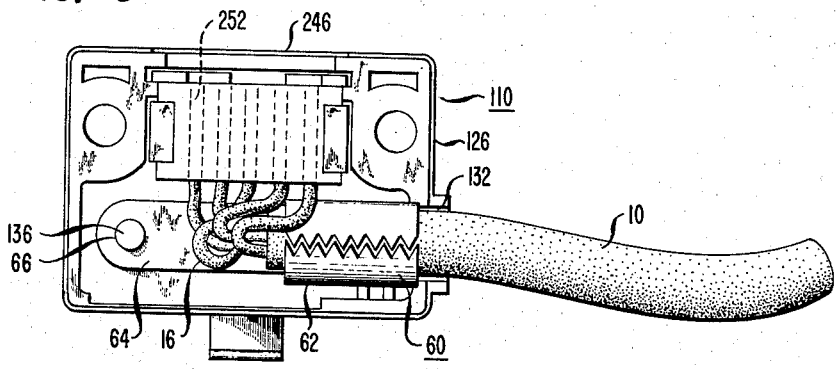
FIG. 5 is a top view of the modular connector assembly showing a mounting cord and its insulated conductors in place before fastening of the cover.

FIG. 5 shows a mounting cord 10 and its strain relief band 60 in position in the connector assembly 110 and ready for fastening of the cover 220 with the connector assembly 110. As can readily be seen, the aperture 66 of the tab 64 loops into the post 136, while the cord 10 seats into the semicylindrical cutout 132 of the sidewall 126 on the right in FIG. 5. Each of the conductors 16 has been threaded into its corresponding orifice 252 on the receptacle 240. Also, the conductor receptacle 240 has been manually pushed down against the contact holding body 182 to mechanically hold the conductors 16 with the top tangs of the contacts 184. Extraneous lengths of the conductors 16 projecting from the rear wall 246 have been severed.

Figure 6:
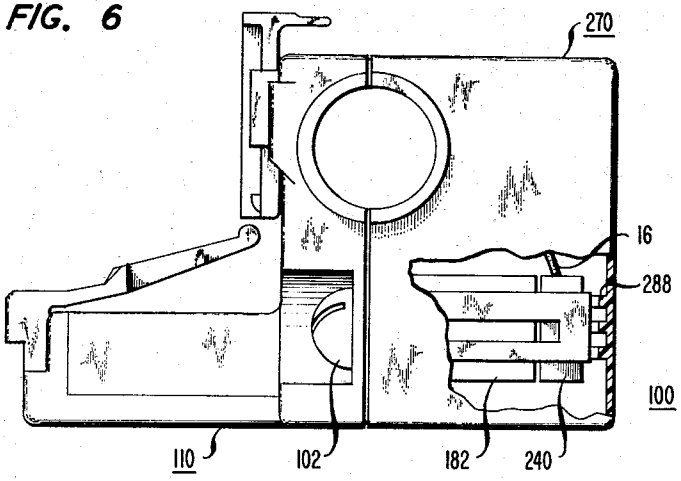
FIG. 6 is an end view in partial cross section of the assembled cord adapter.

FIG. 6 shows the adapter 100 assembled with the mounting cord 10 not illustrated at the access opening. As the screws 102 are alternately driven onto the holes 294 (FIG. 2) in the cover 270, the ribs 288 in the cover 270 apply sufficient force on the receptacle 240 to urge the cord conductors 16 contained therein into reliable intimate electrical contact with the corresponding contacts 184 carried in the contact holding body 182 as can be seen in FIG. 7.

While the invention has been described with reference to an illustrative embodiment, it is to be understood that various modifications might be made thereto without departing from the spirit and scope of the following claims.

I claim:

1. A cord adapter (100) for terminating a cord (10) including a plurality of insulated conductors (16), the cord adapter comprising:

a dielectric base (112) including a connector portion (116) having terminal members (162);

a plurality of contacts (184), where each contact comprises:

a first set (216) of insulation-piercing tangs for engaging respective ones of the cord conductors (16); and a second set (218) of insulation-piercing tangs;

a contact holding body (182), made from dielectric material, and comprising:

a first surface (190);

a plurality of spaced-apart, parallel conductor-receiving bores (204) contained in a plane substantially parallel to the first surface; and a plurality of spaced-apart, parallel contact-receiving slots (208), where each slot (208) is in communication with the first surface and one of the bores, each slot being configured to accommodate a contact such that the first set of tangs protrudes beyond the first surface and the second set of tangs protrudes into its associated bore;

means for aligning (148, 202) the contact holding body with the base; and a plurality of second insulated conductors (186), each second conductor having a first end threaded into an associated bore and in intimate electrical connection with the second set of tangs of the associated contact, and having a second end contained in the connector portion (116) of the base and in intimate electrical connection with a terminal member (162), whereby the connections at both ends of the second conductors (186) help to secure the body to the base.

2. A connector assembly for making electrical connection to a plurality of insulated conductors, the connector assembly including:

a dielectric conductor receptacle (240) including sidewalls (250), a first surface (244) and a second surface (242) facing away from each other, and means (252) for accommodating the insulated cord conductors;

a plurality of conductive contacts (184) for displacing the insulation from the insulated cord conductors to make electrical connection with the conductors;

dielectric means for holding the contacts so as to permit their engagement with the insulated cord conductors; and means for aligning the conductor receptacle with the contacts, the aligning means allowing movement of the conductor receptacle between a first stable position wherein the insulated cord conductors are accommodated by the conductor receptacle and a second stable position wherein the contacts engage the cord conductors the aligning means comprising:

first and second substantially upright cantilevered members (188), each having a free-standing end and a wall (228) facing the other member, each facing wall comprising:

a substantially upright first surface (230) adjacent the free end;

a second surface (232) inclined with respect to the first surface;

a substantially upright third surface (234) connected to the second surface and jutting outward beyond the first surface, where the cantilevered members are capable of being spaced-apart such that the first surfaces engage the conductor receptacle sidewalls and hold the conductor receptacle in the first stable position, and whereupon pressure against the second surface (242) of the conductor receptacle, the cantilevered members are capable of deflecting away from each other to accommodate the conductor receptacle sidewalls for interference engagement against the third surfaces;

a dielectric base including a connector portion having terminal members electrically connected to the contacts; and a cover having means for engaging the second surface of the conductor receptacle, the joining of the cover to the base moving the conductor receptacle from its first to its second stable position.

3. The connector assembly (110) pursuant to claim 2 where the cantilevered members (188) each have different transverse cross sections; and where each sidewall (250) of the conductor receptacle (240) comprises a notch (260) having a different size to correspond to and engage with the assigned cantilevered member.

4. A cord adapter for terminating a cord including a plurality of insulated conductors, the cord adapter comprising:

a dielectric base including a connector portion having a plurality of terminal members;

a plurality of second insulated conductors, each second conductor having one end electrically connected to an individual terminal member;

a plurality of contacts, each contact comprising:

a first insulation displacing element for displacing the insulation from a cord conductor to make an electrical connection with the conductor, and a second insulation displacing element;

a dielectric contact holding body comprising:

a first surface;

a plurality of generally parallel conductor receiving portions for accommodating the other ends of the second conductors, the conductor receiving portions being spaced from the first surface; and a plurality of contact receiving slots, where each slot is in communication with the first surface and one of the conductor receiving portions, each slot being configured to accommodate a contact such that the first insulation displacing element protrudes beyond the first surface and the second insulation displacing element protrudes into an associated conductor receiving portion, the second insulation displacing element displacing the insulation from an associated second conductor to make an electrical connection with the conductor; and means for aligning the contact holding body with the base, the connections at both ends of the second conductors serving to secure the contact holding body to the base.

5. A connector assembly for terminating a cord having a plurality of insulated conductors with a plug adapted to mate with a telephone modular jack, the connector assembly comprising:

electrical contact means including planar contact elements for making electrical connection to a mating connector and insulation displacing elements for making electrical connection to the insulated conductors, each planar contact element being in electrical continuity with an individual insulation displacing element;

dielectric means for supporting the contact means, the contact support means including a plug portion in which the planar contact elements are located, the plug portion being configured to mate with a telephone modular jack, the contact support means further including a second portion situated behind the plug portion in which the insulation displacing elements are located, the insulation displacing elements being arranged in a spaced array and each insulation displacing element being electrically insulated from the other insulation displacing elements;

a dielectric conductor receptacle including a first surface, a plurality of spaced-apart generally parallel conductor-receiving portions located adjacent to the first surface for respectively receiving the insulated conductors, and a plurality of openings extending between the first surface and the conductor-receiving portions, the openings being in a spaced array conforming to the spaced array of the insulation displacing elements, and each opening being configured to accommodate an individual insulation displacing element, the positioning of the openings of the conductor receptacle in registration with the insulation displacing elements combined with the positioning of the first surface of the conductor receptacle in intimate engagement with the second portion of the contact support means resulting in the insulation displacing elements extending into the conductor-receiving portions of the conductor receptacle, each insulation displacing element displacing the insulation from the individual insulated conductor positioned within the associated conductor-receiving portion to make electrical connection to the conductor and to electrically connect the conductor to an individual planar contact element.

* * * * *